US005156307A

United States Patent [19]

Callahan et al.

[11] Patent Number: 5,156,307

[45] Date of Patent: Oct. 20, 1992

[54] DISPENSER FOR FOAMING OF A FILLED LIQUID MATERIAL

[76] Inventors: George E. Callahan, Feldstrasse 34; Harald Koch, Windscheidstrasse 28, both of D-4000 Düsseldorf 1, Fed. Rep. of Germany

[21] Appl. No.: 673,534

[22] Filed: Mar. 22, 1991

[30] Foreign Application Priority Data

Mar. 24, 1990 [DE] Fed. Rep. of Germany ..... 4009574

[51] Int. Cl.[5] ..... B67D 5/58

[52] U.S. Cl. ..... 222/189; 222/190; 222/207; 222/211; 222/212; 239/327; 239/343; 239/405

[58] Field of Search ..... 222/189, 190, 206, 207, 222/211, 212, 213; 239/327, 343, 404, 405, 406

[56] References Cited

U.S. PATENT DOCUMENTS

| | | | |
|---|---|---|---|
| 3,709,437 | 1/1973 | Wright | 222/190 X |
| 4,044,923 | 8/1977 | Gardner | 239/343 X |
| 4,429,834 | 2/1984 | Ito | 222/190 X |
| 4,836,422 | 6/1989 | Rosenberg | 239/327 X |
| 4,925,106 | 5/1990 | Maas et al. | 239/343 X |
| 5,099,885 | 3/1992 | Nilsson | 222/207 X |

*Primary Examiner*—Andres Kashnikow
*Assistant Examiner*—Joseph A. Kaufman
*Attorney, Agent, or Firm*—Shoemaker and Mattare Ltd.

[57] ABSTRACT

The dispenser has a circular mixing chamber (8) which is arranged immediately in front of a mixing nozzle (7). A first channel (15) leads to the mixing chamber (8) which is connected with a rising pipe which is immersed in the filled material of a squeezable container. Simultaneously, a second channel (9) leads into the mixing chamber which is connected to the air space above the filled material. A sieve arranged in the outlet channel (19) at a distance after the mixing nozzle which completely covers the outlet channel under the effect of the pressure of the filled material flowing out when the container (1) is squeezed. With release of the container, the sieve partially releases the outlet channel under the suction effect of the air return flow. With that, the container is rapidly ready for a renewed press sequence.

12 Claims, 5 Drawing Sheets

DISPENSER FOR FOAMING OF A FILLED LIQUID MATERIAL

BACKGROUND OF THE INVENTION

This invention concerns a dispenser for foaming a liquid filled material. Dispensers with which an air-filled material mixture is foamed by means of an additional sieve attachment are widely known. DE-C-29 25 528, for example, shows a device with a hand pump.

Foaming is more problematic in the case of squeezable containers, whereby the container walls must rapidly expand again. In particular when using fine mesh sieves, the problem can arise that, after activation of the dispenser, the required re-expansion of the squeezable container ensues too slowly. This is because the sieve offers a large resistance to the air flowing in, in particular if it is moistened with a semi-liquid filled material or is partly blocked as a result of long term use. Because, however, certain applications of the dispenser demand a fine meshed sieve, in this connection the container must be made to be stiffer in order that it will expand again in a reliable way. This has, however, once again the disadvantage that squeezing of the container is made more difficult. It is therefore the purpose of the invention to create a dispenser of the type mentioned above which ensures an optimal foaming of the filled material and a rapid activation sequence.

SUMMARY OF THE INVENTION

According to the invention, this purpose is fulfilled with a dispenser as described below. In this way the returning air can flow into the inside of the container without great resistance and the container is immediately ready for a renewed spray procedure.

The procedure for air refilling can be further accelerated if the outlet channel is connected by means of a ventilation channel with the inside of the container and if the sieve possesses a closing body which closes off the ventilation channel when the outlet channel is covered and exposes the ventilation channel when the outlet channel is partly uncovered. With that, the sieve also has a kind of valve function, whereby the activation of the valve ensues through either underpressure or overpressure in the outlet channel.

A common mixing chamber in front of the mixing nozzle ensures optimal turbulence of the filled material with the ejected air, regardless of which of the two channels the filled material was introduced into the mixing chamber through. Both channels could, without problems, open out into the mixing chamber tangentially, acting in the same direction. It is, however, also possible that one of the two channels opens out into the mixing chamber on the same axis as the mixing nozzle.

Since the flow of filled material and the force of gravity are both acting in the same direction during activation of the dispenser in the overhead position, increased ejection of filled material will result, with a simultaneous reduction of the air volume. A very inadequate or incomplete atomisation will result in a very wet foam which tends to rapidly flow off. Also when the dispenser is in the overhead position and not activated, depending on its viscosity, the liquid filled material can flow out. The altered conditions in the overhead position can be compensated for in a particularly advantageous way if the second channel is provided with a valve that partly or totally closes off the second channel when the container is in the overhead position.

This valve could also be arranged fully independently from the fact that both channels open out into a common mixing chamber. In the case of only a partial closure of the second channel by the valve, this valve will have the effect of a throttle valve, so that the proportion of ejected air to filled material can be maintained.

In certain cases in the overhead position it can be desirable, however, that the valve fully closes the second channel so that no filled material can be ejected, also when squeezing the container.

The valve can, to particular advantage, exhibit a valve body which is held, freely moveable, in a cage-like holder and which rests on a valve seating in the overhead position. The cage-like holder can be easily integrated into the spray head, and a ball, for example, can be used as a valve body.

According to requirements, also numerous sieves can be arranged one behind the other in the outlet channel. It would be also conceivable for numerous channels to guide the air, respectively filled material. The measures described improve the properties of a squeezable foam dispenser all told.

BRIEF DESCRIPTION OF THE DRAWINGS

Further individual features and advantages arise out of the following description and from the drawings, wherein.

DESCRIPTION OF THE PREFERRED EMBODIMENT

Figure 1:
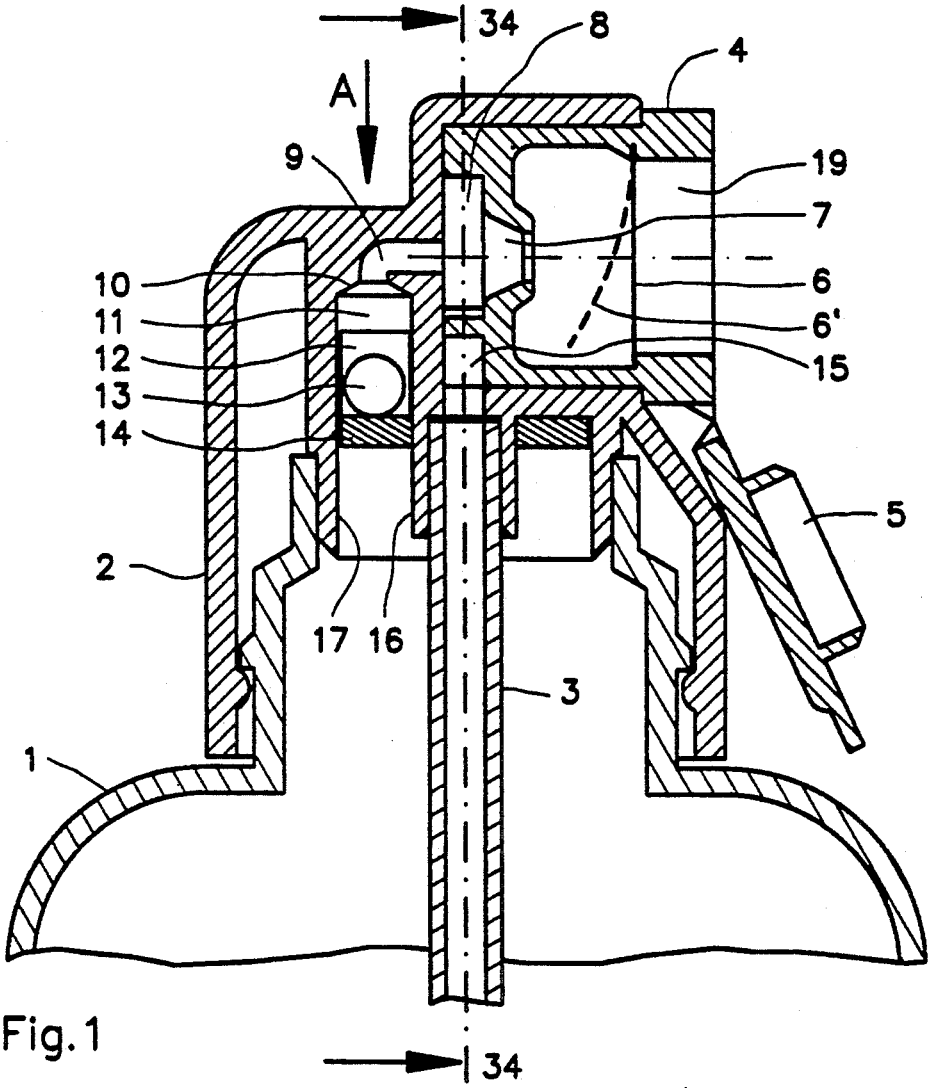
FIG. 1 is a cross-section through a dispenser according to the invention.
Figure 2:
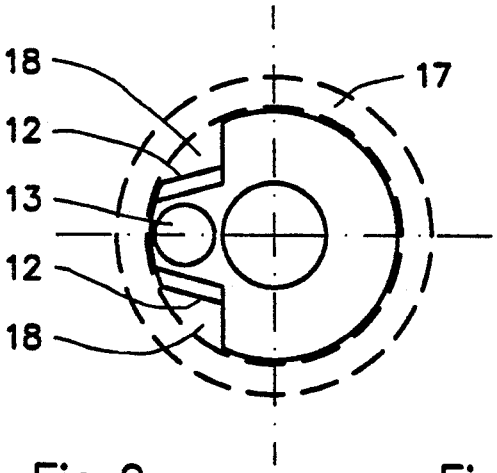
FIG. 2 is a plan view from the direction of the arrow A of a spray head according to FIG. 1.
Figure 3:
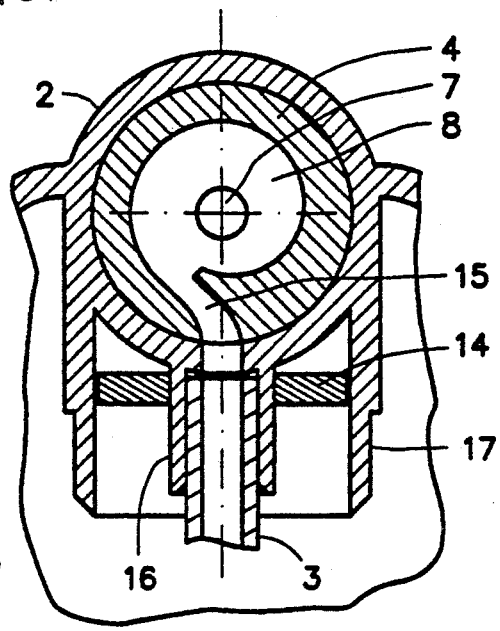
FIG. 3 is a section through the plane 34—34 according to FIG. 1.
Figure 4:
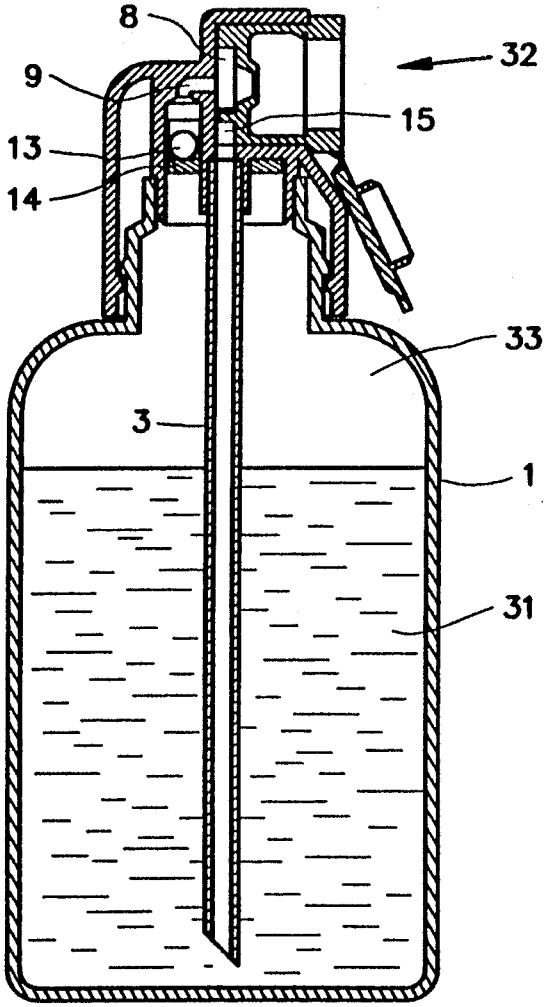
FIG. 4 is a cross-section through a dispenser in the normal position.

In FIGS. 1–3 an embodiment of a dispenser according to the invention is represented. A cap 2 is firmly, connected to a squeezable container 1, made from, for example, plastic. This cap contains a spray insert 4 in which, see FIG. 1, an approximately circular mixing chamber 8 and a conical mixing nozzle 7 are arranged. A first channel 15 leads to this mixing chamber, as well as a second channel 9 from the inside of the container. A rising pipe 3 is fixed in a connection piece 16 on the cap 2 which, as can be seen in FIG. 4, is immersed in the filled material 31 in the upright container position. The connection piece 16 forms the container orientated end of the first channel 15. This channel opens out tangentially into the mixing chamber 8, as can be observed in FIG. 3.

The second channel 9 leads, at its container end, to a valve which is formed by a cage-like holder 14, a ball 13 and a valve seating 10. The holder 14 is pushed into the connection piece 16 and has webs 12 on its sides, between which the valve ball of metal, plastic or ceramic is held. The webs 12 are limited in their height in such a way that the openings 11 remain between them and the cap 2. The channels 18, which connect the inside of the container, that is, the air space 33 above the filled material with the second channel 9 through the openings 11, run between the webs 12 and a sealing collar 17 which protrudes into the container opening.

The second channel 9 opens out into the mixing chamber 8 on the same axis as the mixing nozzle 7. According to the particular type of use, the bevelled valve seating 10 is formed in such a way that it completely closes off the channel 9 when the valve ball 13 is resting upon it. The valve seating can also be provided with numerous fine radial grooves so that the valve merely functions as a throttle valve and the flow volume will be reduced when the ball is resting upon it.

The mixing nozzle 7 opens out into an outlet channel 19 which, when used with a foamable liquid, is provided with a moveable sieve 6 which is arranged at a distance from the mixing nozzle. In the case of the portrayed embodiment, the outlet channel 19 is able to be closed with a flap lid 5 which is attached with a hinge to the spray insert 4. The flap lid 5 prevents in particular drying out and congealment on the sieve 6.

When the container 1 is squeezed, as a result of the increased inner pressure the filled material 31 flows through the rising tube 3 and the first channel 15 into the mixing chamber 8. Simultaneously, air reaches the mixing chamber 8 from the air space 33 through the channels 18, the openings 11 and the second channel 9. The first channel 15 leads tangentially into the mixing chamber, by which means the liquid flowing in is set into rotation and thus mixes itself with the air flow fed to the centre through the second channel 9. This air-liquid mixture is accelerated through the conical mixing nozzle 7 towards the outside of the container and released as a spray mist. A foaming of this mixture ensues with the employment of the sieve 6.

Figure 5:
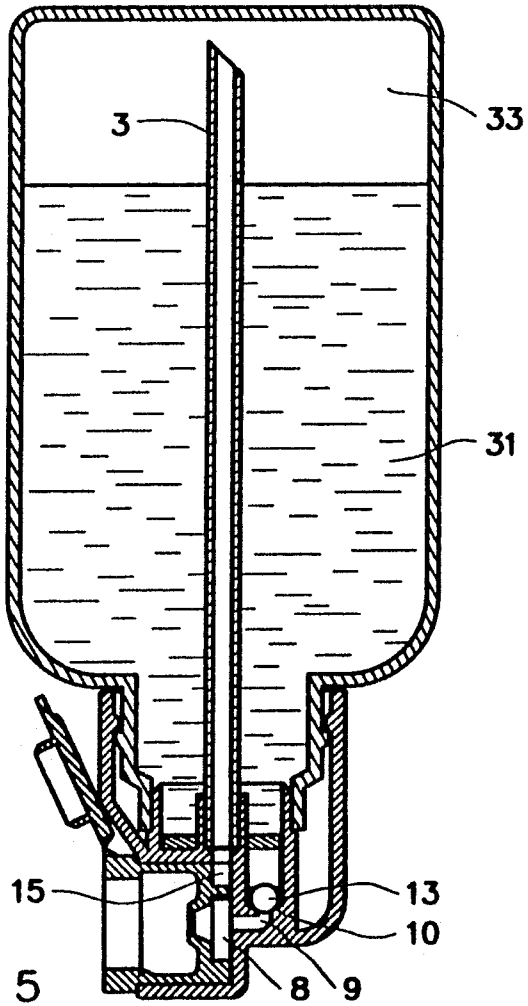
FIG. 5 is a cross-section through a dispenser in the overhead position.
Figure 6:
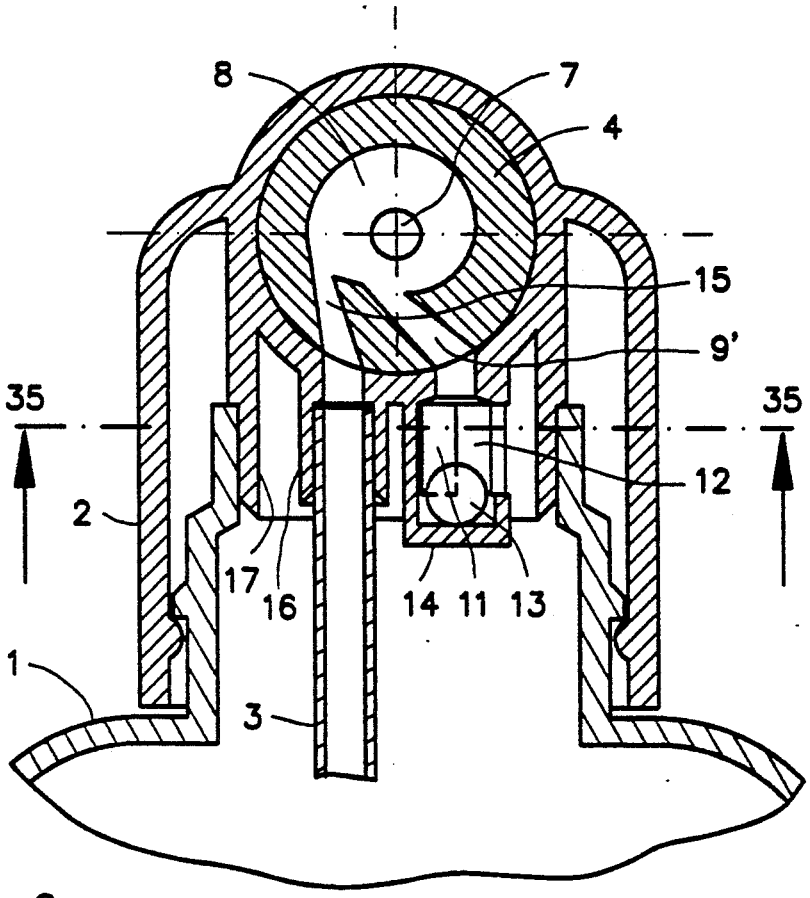
FIG. 6 is a section through an alternative embodiment of the dispenser.
Figure 7:
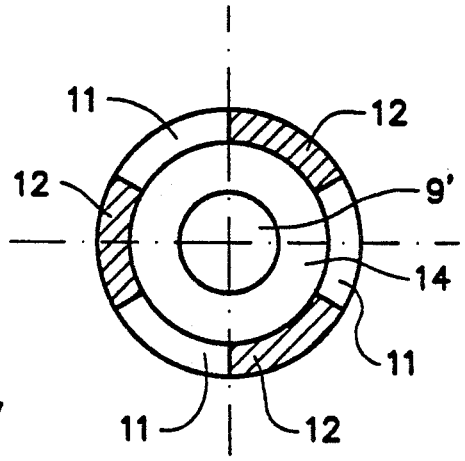
FIG. 7 is a section through the plane 35—35 according to FIG. 6.

In the normal container position, as depicted in FIG. 4, the valve has no effect. The air can flow unimpeded into the mixing chamber 8 without the ball 13 changing its position within the holder 14 and influencing the air flow. The proportion of air to liquid is solely determined through the respectively smallest cross-sections of the channels 9 and 15. If the container is, however, brought into the overhead position—as is depicted in FIG. 5—the rising tube 3 will protrude into the air space 33, so that in this position the mediums in the channels change over. The air now reaches the mixing chamber 8 tangentially through the rising tube 3 and the first channel 15. The filled material is led into the mixing chamber through the channel 18, the openings 11 and the second channel 9, where it is mixed with the air flow which is now set in rotation. Since the flow of the filled material and the gravity effecting it are now aligned in the same direction, in the overhead position a strongly increased liquid ejection will occur without additional measures being taken when pressure occurs within the container. In certain cases liquid could also flow out without the container being activated in any way. This undesirable side effect is reliably cured, however, by the valve. When the container is tilted, the ball 13, as a result of gravity, moves against the bevelled valve seating 10 where, as already mentioned, it either fully or partially closes the second channel. When the container is tilted back again into the upright position the ball falls back into its start position and completely exposes the channel 9 once again. In FIGS. 6 and 7, a second embodiment of a dispenser according to the invention is depicted. In this version not only the first channel 15 but also the second channel 9' open out tangentially, in the same direction, into the mixing chamber 8. Since both of the mediums are set into rotation within the mixing chamber in the same rotational direction, the turbulence is increased. Here too, the valve comprises a holder 14, provided with the webs 12 and the slot shaped openings 11, which takes the form of a cylindrical cage in which the ball is held fast, but freely moveable. The blocking or reduction of the liquid flow in the overhead position is achieved through the appropriate positional change of the ball 13, which lies on the either polished or uneven valve surface 10 and either partially or completely closes off the channel 9'.

For application as a foam dispenser, the optional use of the central inlet according to FIGS. 1 to 3, or alternatively the tangential inlet according to FIG. 6, is advantageous. For the production of foam this has the effect that in the first case the foam is able to be applied with a higher speed and greater range, as opposed to the second case, where it can be applied with less range and an almost spiral form.

Figure 8:
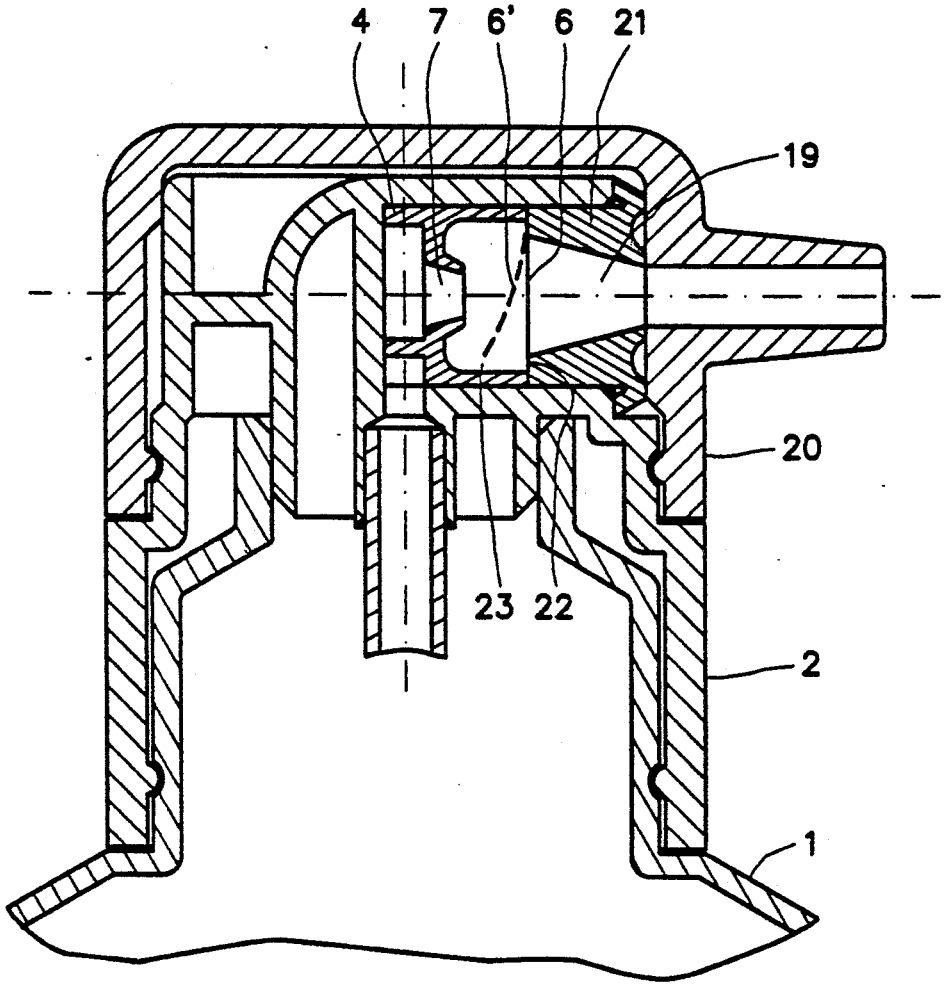
FIG. 8 is a cross-section through a further embodiment of a dispenser with a moveable clamped foam sieve.

In FIG. 8, a third embodiment of the dispenser according to the invention is portrayed in the upright position and in an opened condition. This form is, on the basis of its rotatable nozzle top 20, particularly easy to close. Although a version with two tangential inlets as in FIG. 6 is portrayed, a central inlet as in FIG. 2 could just as well be used. The previously described valve device is not depicted here for reasons of simplicity.

A cap 2 is firmly connected to the container 1, whereby the cap carries a nozzle top 20, pivotable around the cap axis, the inner wall of which, in its closed condition, lies in front of the seal insert 21 and in this way closes the dispenser. The cap 2 contains the spray insert 4 and the seal insert 21 between which the sieve 6 is fastened only on one side. On compression of the container, the air-liquid mixture exiting the mixing nozzle 7 strikes the sieve 6 and presses this against the facing surface 22 of the seal insert 21 so that it completely fills the cross-section of the outlet channel 19. Thus, the mixture must pass through the sieve in order to leave the dispenser through the outlet channel. After activation of the dispenser, as a result of the re-expansion of the container 1, air is sucked in through the outlet channel 19. Since the sieve is flexibly formed, the unfixed lower side is moved by this flow of air towards the inside of the container and achieves the approximate position of 6'. The air gap 23 opens out between the sieve in the position 6' and the spray insert 4 through which a portion of the air flowing in can reach the container unimpeded and without having to pass through the sieve. In particular when fine mesh sieves are used, the re-expansion of the container is clearly accelerated as a result of this. Thus, from the outset, softer containers can be used which considerably facilitates the activation of the dispenser.

In the embodiment according to FIG. 8, the existing sieve 6, for example made of plastic, is moveable since it is held in position between the spray insert 4 and the seal insert 21 only by its upper edge. The flexible weave distorts in the flow of air entering the container in such a way that, in its position 6', the air flows around it, underneath and at the sides. Obviously a rigid sieve, for example from a metal weave, can be mounted moveably in such a way that on one side it is sprayed or welded ultrasonically onto a thin plastic flap—a so-called film hinge.

Figure 9:
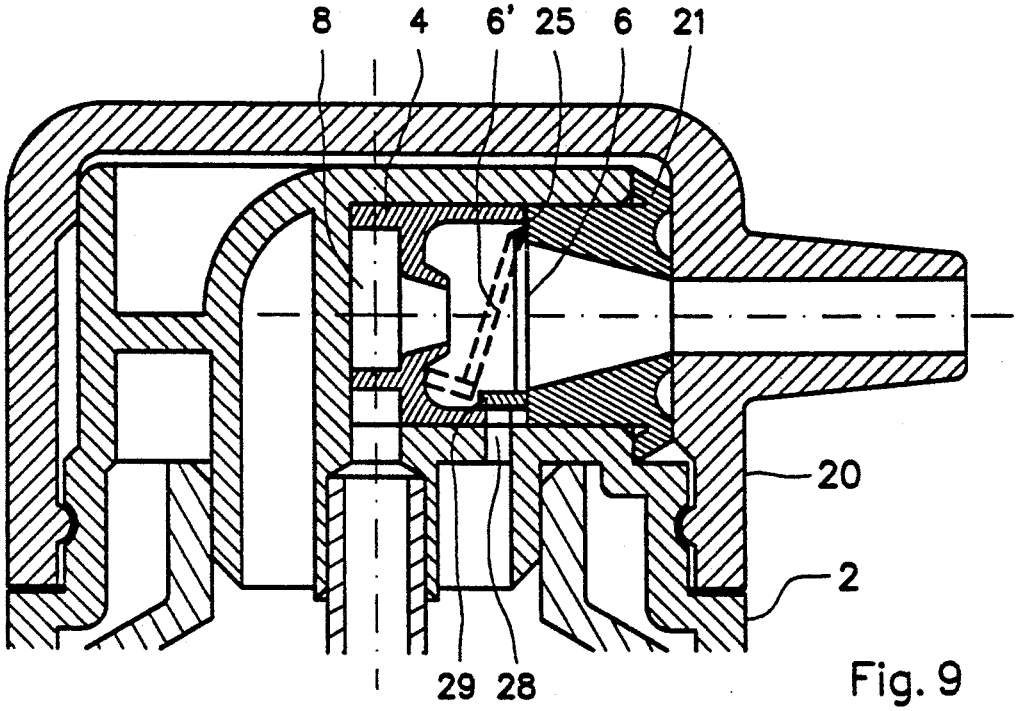
FIG. 9 is an alternative embodiment of a foam sieve with covering plate.

Such a sieve with a film hinge 25 is shown in FIG. 9, for example. The return air flow here reaches the inside of the container still faster, however, through a ventilation channel 28. This ventilation channel immediately connects the air space 33 in the container with the outlet channel 19. The sieve 6 carries on its freely moveable lower edge a cover 29 which fully closes the ventilation channel 28 on ejection of the air-filled material mixture. The opened position, with the ventilation channel 28 exposed, is portrayed with a broken line.

Figure 10:
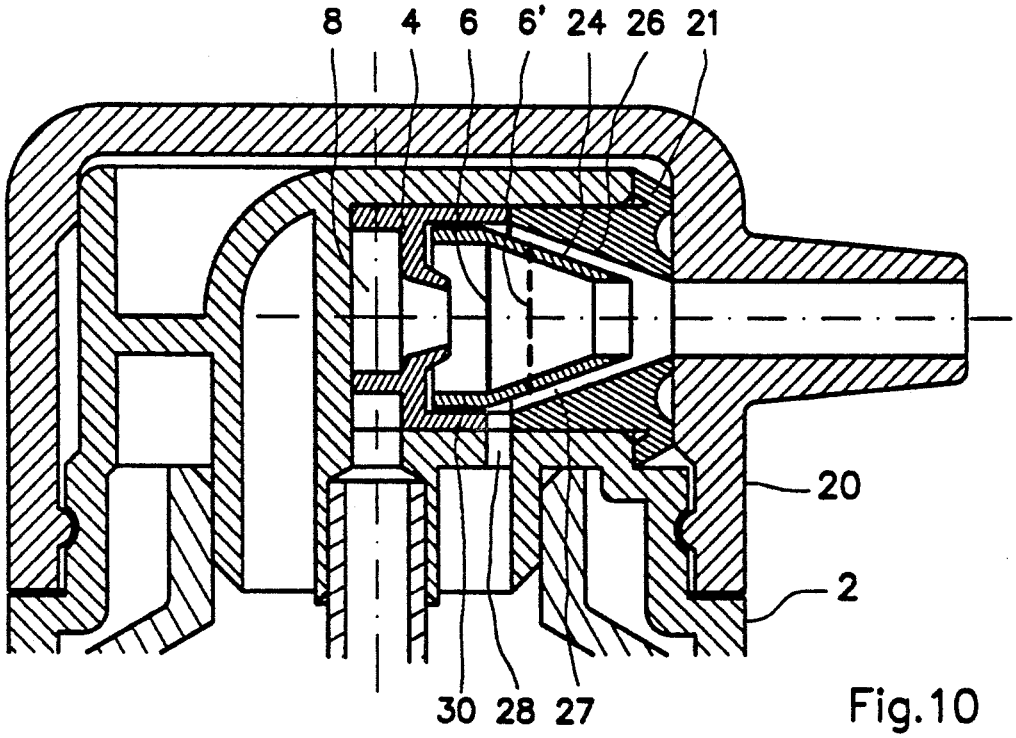
FIG. 10 is an alternative embodiment of a foam sieve with a hollow cone.

A further embodiment of a sieve equipped with a closing body is portrayed in FIG. 10. The sieve 6 is not fixed with a hinge in this case, but is arranged firmly in a rotationally symmetrical hollow body. The hollow body comprises a hollow cone 24 and a cylindrical attachment 30. The hollow cone is held to slide axially in the outlet channel, with respect to the seal insert 21. With return air flow into the inside of the container, the hollow cone finds itself in the position depicted, so that an annular gap 27 is formed through which the air can flow unimpeded to the ventilation channel 28. On ejection of the air-filled material mixture the hollow cone is pressed against the internal cone 26 on the seal insert 21, so that the annular gap 27 is completely closed. At the same time the attachment 30 closes off the ventilation channel 28 so that air can no longer flow out through it. The sieve adopts the approximate position according to 6'.

We claim:

1. Dispenser for foaming a liquid material, said dispenser comprising a squeezable container (1) having an interior with an upper portion for containing a gas, and a lower portion for containing the liquid material, a spray head (32) mounted on the container, said spray head comprising a mixing nozzle (7) and an outlet channel (19) downstream of the mixing nozzle, at least two fluid conduits, one connecting the nozzle to a rising tube extending into said lower container portion, and another connecting the nozzle to said upper container portion, and a sieve (6) disposed in the outlet channel at a substantial distance downstream of the mixing nozzle (7), said sieve being hingedly connected to one side of the outlet channel, so as to be movable between a first position fully blocking the outlet channel, when the container is squeezed, and a second position at least partially unblocking the outlet channel when the container is released, to permit unimpeded return air flow.

2. Dispenser according to claim 1, wherein the outlet channel (19) is connected with the inside of the container through a ventilation channel (28) and that the sieve (6) includes a closure body which closes the ventilation channel (28) when the outlet channel (19) is covered and exposes the ventilation channel when the outlet channel is partially released.

3. Dispenser according to claim 2, wherein the closure body is a covering plate (29) arranged on a freely moveable section of the sieve, with which the ventilation channel (28) is able to be closed.

4. Dispenser according to claim 1, wherein a common mixing chamber (8) with an approximately circular cross-section is arranged in front of the mixing nozzle (7) into which the first channel (15) and the second channel (9) open out, and at least one of the two channels opens out tangentially into the mixing chamber.

5. Dispenser according to claim 4, wherein both channels open out tangentially into the mixing chamber, with the same alignment.

6. Dispenser according to claim 4, wherein one of the two channels open out into the mixing chamber on the same axis as the mixing nozzle (7).

7. Dispenser according to claim 4, wherein the second channel (9) is provided with a valve which fully or partially closes the second channel (9) when the container (1) is inverted.

8. Dispenser according to claim 7, wherein the valve comprises a valve body (13) which is mounted to freely move in a cage-like holder (14) and which rests upon a valve seating (10) when the container (1) is in the overhead position.

9. The invention of claim 1, wherein the sieve is made of a flexible material.

10. The invention of claim 1, further comprising a spray insert, a seal insert for holding the spray insert in position, the nozzle being disposed within the spray insert, and the sieve being arranged between the spray insert and the seal insert.

11. The invention of claim 10, wherein the seal insert has a conical outlet channel.

12. The invention of claim 10, further comprising a rotatable nozzle top for opening and closing the outlet channel in the seal insert.

* * * * *